United States Patent [19]

Manson

[11] 4,086,509

[45] Apr. 25, 1978

[54] SANDWICHED SLIP RING ASSEMBLY

[75] Inventor: Harry G. Manson, Princeton, Ind.

[73] Assignee: Hansen Manufacturing Company Inc., Westbury, N.Y.

[21] Appl. No.: 720,152

[22] Filed: Sep. 3, 1976

[51] Int. Cl.[2] ..... H01R 39/10

[52] U.S. Cl. ..... 310/232

[58] Field of Search ..... 310/232, 229, 230, 231, 310/219

[56] References Cited

U.S. PATENT DOCUMENTS 3,837,229 9/1974 Stiles et al. ..... 310/232 X

*Primary Examiner*—Mark O. Budd

[57] ABSTRACT

A stationary disc of electrically insulating material is sandwiched between two rotating discs of electrically insulating material, the rotating discs carrying electrical contacts and the stationary disc carrying electrical brushes engaging the electrical contacts.

6 Claims, 4 Drawing Figures

SANDWICHED SLIP RING ASSEMBLY

Generally speaking the present invention relates to a slip ring assembly which comprises a pair of rotating discs of electrically insulating material, a stationary disc of electrically insulating material sandwiched between the pair of rotating discs, cooperating electrical contact rings and electrically conductive resilient brushes carried by the stationary and rotating discs, and electrical leads in electrical contact with the contact rings and brushes.

Slip ring assemblies are known for use in transferring electric power between objects which are rotating relative to one another. For example, they are used in motors and generators as a means of transferring electric current to or from rotating armatures. In general, prior art devices of this type have been complicated, expensive, and difficult to produce. In contrast to this, the present invention provides a slip ring assembly which is simple in construction, easy to produce and relatively low in cost.

It is therefore a feature of the present invention to provide a slip ring assembly which is simple and easy to produce. Another feature of the invention is to provide a slip ring assembly which includes a stationary disc sandwiched between two rotating discs. Another feature of the invention is to provide such a slip ring assembly wherein cooperating electrical contact rings and electrical brushes are carried by the stationary and rotating discs. Yet another feature of the invention is to provide such a slip ring assembly wherein a bearing surface is provided between the peripheries of the stationary and rotating discs. Another feature of the invention is the provision of such a slip ring assembly wherein the bearing surface also provides a sealing means to prevent dust and other deleterious material from entering the assembly. Still another feature of the invention is the provision of such a slip ring assembly wherein the stationary disc is comprised of two sections each section having a cavity which when mated together provide a compartment for electrical leads. Another feature of the invention is the provision of such a slip ring assembly wherein said rotating discs include passageways receiving electrical leads.

Figure 1:
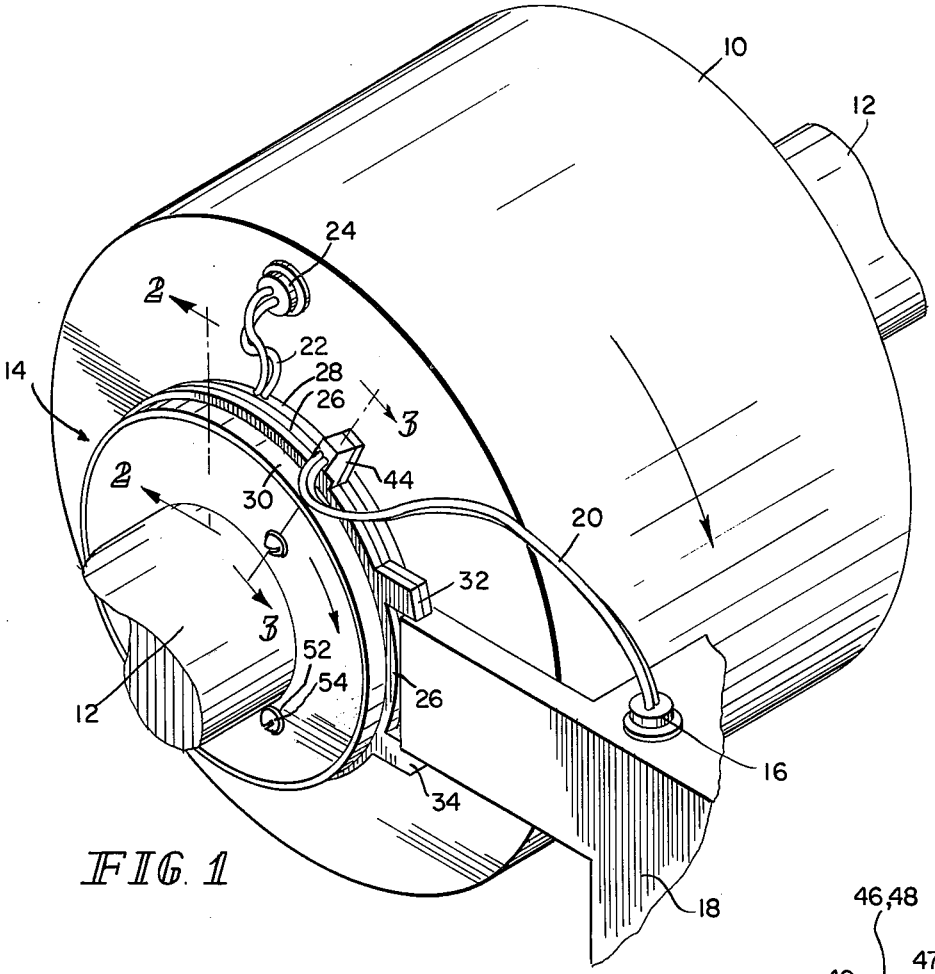
Figure 4:
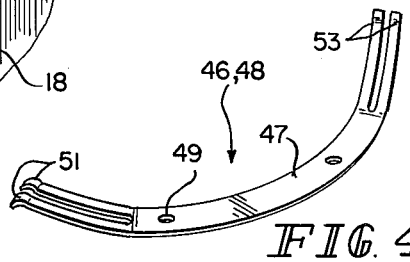
Figure 2:
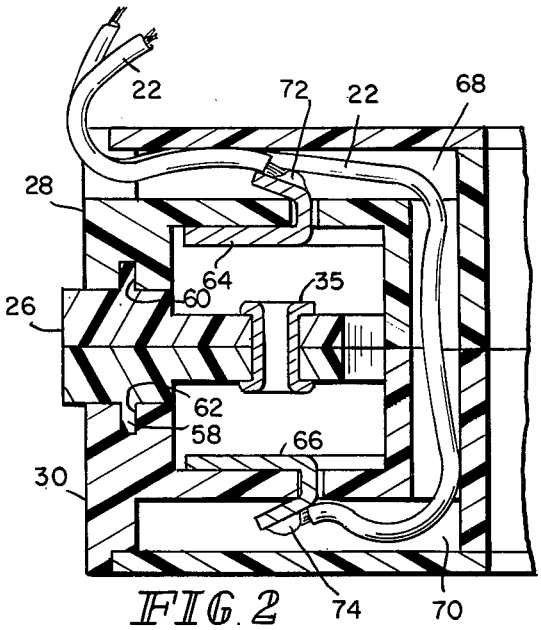
Figure 3:
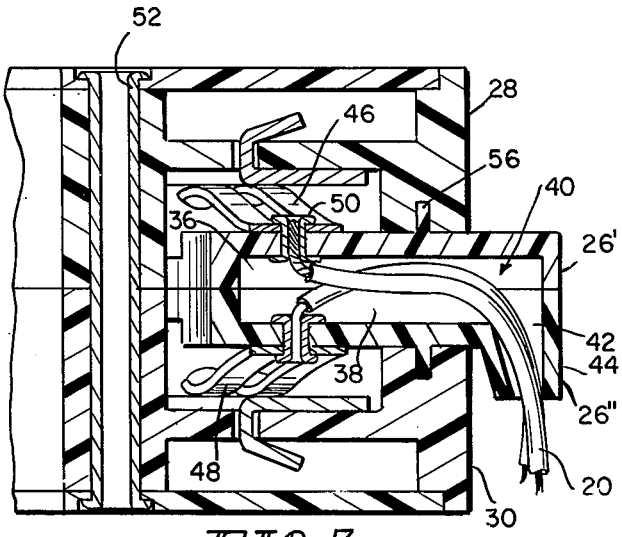

These and other features of the invention will become apparent from the following description taken in conjunction with the accompanying drawings wherein:

FIG. 1 is a perspective view of the slip ring assembly in combination with a rotating member to which electrical current is to be supplied;

FIGS. 2 and 3 are partial sections taken along the lines 2—2 and 3—3, respectively, of FIG. 1; and FIG. 4 is a view showing the shape of an electrical brush used in the slip ring assembly.

Referring now to the drawings, there is shown a drum 10 which is carried by and rotating with shaft 12 and a slip ring assembly 14 connected to the drum. Drum 10 is, for the purpose of this disclosure, meant to represent any rotating element to which electrical power needs to be supplied, which in the interest of simplicity is not shown in detail. For example drum 10 could represent a rotating armature of a motor or generator. Electrical power is to be supplied to the drum from a stationary outlet 16 which is carried on a stationary frame 18. The electrical power is supplied from the stationary outlet through electrical leads 20, through the slip ring assembly 14 to leads 22 to terminal 24.

Slip ring assembly 14 includes a stationary disc 26 sandwiched between a pair of rotating discs 28 and 30, the discs being fabricated from an electrically insulative material. Stationary disc 26 is held in a fixed position through ears 32 and 34 extending from the stationary disc and engaging stationary frame 18. As shown, stationary disc is comprised of two sections 26' and 26'' held together by a plurality of eyelets 35. Each section includes a cavity 36 and 38 which when mated together provide a compartment 40 for receiving electrical leads 20 through an aperture 42 provided in a neck portion 44 of section 26''. Electrically conductive resilient brushes 46 and 48 are carried on opposed surfaces of the stationary disc 26 through a plurality of eyelets 50, electrical leads 20 making electrical contact with the brushes through two of the eyelets. As shown in FIG. 4, brushes 46 and 48 include a body portion 47 having apertures 49 through which eyelets 50 extend and pairs of fingers 51 and 53 extending from the body portion.

Rotating discs 28 and 30 are held together through a plurality of eyelets 52. The whole slip ring assembly 14 is held to the drum 10 through a plurality of bolts 54 which are fed through the eyelets and bolted to the drum. Thus when drum 10 is rotated, rotating discs 28 and 30 are rotated therewith while stationary disc 26 remains fixed through the cooperation of frame 18 and ears 32 and 34. Ribs 56 and 58, extending from opposed faces of the stationary disc near its outer periphery, cooperate with grooves 60 and 62, provided in the rotating dics near their outer peripheries, to provide a bearing surface for the rotating discs. In addition, when in use, a suitable grease is applied to the rib to act as a sealing means to prevent dust or other deleterious material from entering the assembly.

Electrical contact rings 64 and 66 are carried by the rotating discs in spaced relation to brushes 46 and 48 to be engaged thereby by the fingers 51 and 53. Each of the rotating discs includes annuli 68 and 70 which provide passageways for electrical leads 22 which are electrically connected to the electrical contact rings through soldered joints 72 and 74.

In operation, when drum 10 rotates, rotating discs 28 and 30 rotate so as to rotate electrical contact rings 64 and 66. The contact rings brush over resilient electrically conductive brushes 46 and 48 to maintain electrical continuity between leads 20 and 22.

What is claimed is:

1. A slip ring assembly comprising:

a. a pair of annular rotatable disks of electrically insulative material, each of said disks having a central opening extending completely through its thickness aligned with the central opening of the other, b. a stationary annular disk of electrically insulative material sandwiched between said pair of rotating disks, said stationary disk having a central opening extending completely through its thickness aligned with the central openings of said rotatable disks, said aligned openings in said disks being capable of accommodating a shaft, c. a closed annular chamber between said rotatable disks, d. cooperating electrically conductive resilient brushes and electrically conductive contact rings carried by said stationary and rotatable disks, said brushes and rings being located entirely within said closed annular chamber, and e. electrical leads electrically connected to said brushes and rings, said leads extending to the exterior of said disks.

2. A slip ring assembly as defined in claim 1 including a bearing surface on each face of said stationary disk, and a cooperating bearing surface on the face of each rotatable disk opposite a face of said stationary disk, each pair of cooperating bearing surfaces being in sliding engagement.

3. A slip ring assembly as defined in claim 2 wherein each pair of cooperating bearing surfaces includes a circular rib projecting from one of the disk faces and a circular groove formed in the opposite face of the other disk, said groove slidably accommodating said rib.

4. A slip ring assembly as defined in claim 1 wherein said stationary disk comprises two disk sections in face-to-face contact, said disk sections being formed to define a compartment between them for accommodating said electrical leads electrically connected to the contact rings or brushes carried by said stationary disk.

5. A slip ring assembly as defined in claim 1 including a passageway within each of said rotatable disks for accommodating electrical leads electrically connected to the contact rings or brushes carried by said rotatable disks.

6. A slip ring assembly as defined in claim 1 wherein an electrically conductive resilient brush is carried by each face of said stationary disk, and an electrically conductive contact ring is carried by the face of each rotatable disk opposite to said stationary disk, each brush being in sliding contact with said ring opposite to it.

* * * * *